US010113496B2

(12) United States Patent
Soliman

(10) Patent No.: US 10,113,496 B2
(45) Date of Patent: Oct. 30, 2018

(54) CONNECTED ENERGY MANAGEMENT AND AUTONOMOUS DRIVING STRATEGY FOR ENGINE CYLINDER DEACTIVATION

(71) Applicant: Continental Automotive Systems, Inc., Auburn Hills, MI (US)

(72) Inventor: Ihab Soliman, Washington, MI (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 0 days.

(21) Appl. No.: 15/597,791

(22) Filed: May 17, 2017

(65) Prior Publication Data

US 2018/0238249 A1 Aug. 23, 2018

Related U.S. Application Data

(60) Provisional application No. 62/462,408, filed on Feb. 23, 2017.

(51) Int. Cl.
*F02D 41/00* (2006.01)
*F02D 17/02* (2006.01)

(52) U.S. Cl.
CPC .... *F02D 41/0087* (2013.01); *F02D 2200/602* (2013.01); *F02D 2200/702* (2013.01)

(58) Field of Classification Search
CPC ..... F02D 17/02; F02D 17/04; F02D 41/00; F02D 41/0087; F02D 41/02; F02D 41/0225; B60W 10/06; B60W 10/08; B60W 10/30; F02N 11/08; F02N 11/0837; F02N 2200/125; F02N 2300/2006; Y02T 10/48; Y02T 10/642
USPC ..... 701/102, 112–115; 123/198 F
See application file for complete search history.

(56) References Cited

U.S. PATENT DOCUMENTS 9,702,315 B1 * 7/2017 Palmer ..... F02D 43/00
2008/0091309 A1 * 4/2008 Walker ..... B60R 25/02 701/1
2011/0295494 A1 * 12/2011 Ma ..... F02D 13/0219 701/112
2014/0094228 A1 * 4/2014 Hamelink ..... H04M 1/6091 455/569.2
2016/0032858 A1 * 2/2016 Kim ..... F02D 41/042 701/102
2017/0080919 A1 * 3/2017 Follen ..... B60W 20/12
2017/0217444 A1 * 8/2017 Chaston ..... B60W 50/08
(Continued)

*Primary Examiner* — John Kwon
*Assistant Examiner* — Johnny H Hoang

(57) ABSTRACT

The present invention is a connected energy management (CEM) strategy for controlling the activation of a plurality of engine cylinders in the engine of a vehicle. A powertrain controller is operable for controlling the operation of the engine, and a second controller is in electrical communication with the powertrain controller. The second controller may be a telematics controller, or an autonomous driving vehicle controller. The second controller communicates at least one parameter to the powertrain controller, and the parameter is used to determine which of the plurality of cylinders are to be activated or deactivated. The powertrain controller then activates or deactivates one or more of the plurality of cylinders using the powertrain controller based on the parameter, which may include various road data, such as road curve shape or road grade. The parameter may also be based on a desired autonomous driving path.

15 Claims, 5 Drawing Sheets

(56) References Cited

U.S. PATENT DOCUMENTS

| | | | | |
|---|---|---|---|---|
| 2017/0328287 | A1* | 11/2017 | Leone | F02D 41/0225 |
| 2017/0328292 | A1* | 11/2017 | Leone | F02B 75/18 |
| 2018/0057004 | A1* | 3/2018 | Muldoon | B60W 30/188 |

* cited by examiner

| Driving Situation | cEM Function | Connected Data Utilized | Cylinder Deactivation Strategy |
|---|---|---|---|
| Approaching Traffic Light (about to turn red in X secs) | Intelligent Traffic Light Assist | dynamic traffic light information | Engine cylinder deactivation extended (& triggered earlier) by using future traffic light status & timing |
| Vehicle Deceleration due to decreasing speed limits | Intelligent Deceleration Assist | static road speed limit data | Engine cylinder deactivation triggered earlier to maximize energy recuperation by reducing pumping losses (xHEV application) |
| Vehicle Deceleration due to increasing traffic congestion | Intelligent Deceleration Assist | dynamic road vehicle data (traffic congestion) | Engine cylinder deactivation triggered earlier to maximize energy recuperation by reducing pumping losses (xHEV application) |
| Vehicle Approaching Road Curvature | Intelligent Curve Assist | static road curvature data (future) | Engine cylinder deactivation extended (& triggered earlier) by using upcoming road curvature knowledge. May be combined with dynamic traffic light information |
| Vehicle Approaching Downhill Road Grade with vehicle traffic | Intelligent Road Slope Assist | static road grade data + dynamic road vehicle data | Engine cylinder deactivation extended due to reduced road load (with downhill grade) in addition to future vehicle traffic |
| Vehicle Deceleration due to Approaching Downhill Road Grade | Intelligent Deceleration+Slope Assist | static road grade data + dynamic road vehicle data | Engine cylinder deactivation switched to fuel cutoff (pumping losses maximized) only for maximized engine breaking for hill descent control |
| Vehicle Creeping During Low Speed Zone (or with traffic) | Intelligent Deceleration+Traffic Light Assist | static road speed limit data + dynamic road vehicle data (traffic congestion) | Engine cylinder deactivation extended using dynamic traffic data information. Expected longer period of low engine load operation |

FIG. 2

CONNECTED ENERGY MANAGEMENT AND AUTONOMOUS DRIVING STRATEGY FOR ENGINE CYLINDER DEACTIVATION

CROSS-REFERENCE TO RELATED APPLICATIONS

This application claims the benefit of U.S. Provisional Application No. 62/462,408 filed Feb. 23, 2017. The disclosure of the above application is incorporated herein by reference.

FIELD OF THE INVENTION

The invention relates generally to a cylinder deactivation strategy based on telematics and connectivity or in combination with parameters associated with autonomous driving.

BACKGROUND OF THE INVENTION

Current internal combustion engine cylinder deactivation strategies are primarily based on the requested propulsion torque at the current vehicle operating conditions, and are used to improve fuel economy. Internal combustion engines have an order in which each piston located in each cylinder is scheduled for firing. In using a cylinder deactivation strategy, cylinders are either scheduled for combustion or deactivation, depending on the engine torque demand, NVH (noise, vibration and harshness), and vehicle/engine constraints. This approach applies to conventional fixed-mode cylinder deactivation systems (e.g., changing between eight active cylinders and four active cylinders, or changing between four active cylinders and two active cylinders), or multi-mode cylinder deactivation systems, in which any number of cylinders in a given engine cycle can be deactivated or fired to meet the engine load demand. In all of these systems, future knowledge of the vehicle operating conditions or vehicle environment is not accounted for or included when scheduling cylinder deactivation (or individual cylinder firings). This typically leads to a suboptimal powertrain fuel efficiency improvement. This is particularly true if frequent changes in the required engine load demand and changes in the upcoming vehicle driving conditions lead to unnecessary cylinder deactivations or potentially poor system response when attempting to reactivate (i.e., fire) some or all of the engine cylinders. A vehicle utilizing engine cylinder deactivation for fuel efficiency gains may encounter these drawbacks in various situations, including, but not limited to: heavy traffic driving, traffic light approaches, road curvatures, road grades, and general vehicle deceleration.

One example of these drawbacks may occur where a vehicle is driven on a road with one or more curvatures. In this instance, a typical engine cylinder deactivation strategy frequently deactivates and reactivates the cylinders as the driver tips in and out (i.e., applies and releases) the accelerator and brake pedals while negotiating a curve. This is to be expected in a conventional cylinder deactivation strategy as current engine load demand changes. This irregular engine cylinder deactivation, or "hunting," may have a negative effect on drivability and fuel efficiency/emissions. One reason these negative effects occur is that as cylinders are fired for reactivation, in particular for a fixed-mode cylinder deactivation system (e.g., changing from eight cylinders to four cylinders, and vice versa), ignition retard is typically used to prevent engine torque surges during the cylinder reactivation. In some engine cylinder deactivation strategies, deactivation hunting is prevented by means of an engine deactivation inhibit hysteresis logic, which prevents further deactivations when the time since the last deactivation was too short. This may lead to fuel efficiency gains that are not realized, since the cylinder deactivation becomes inhibited while preventing hunting.

Accordingly, there exists a need for an optimized engine cylinder deactivation strategy which improves fuel efficiency based on either or both of a combination of vehicle telematics and autonomous driving strategies.

SUMMARY OF THE INVENTION

In one embodiment, the present invention is an optimized engine cylinder deactivation strategy using connected energy management with advanced telematics including both static and dynamic data. In another embodiment, the present invention is an optimized engine cylinder deactivation strategy using connected energy management with autonomous driving strategies. In yet another embodiment, the present invention is an optimized engine cylinder deactivation strategy using connected energy management with advanced telematics including both static and dynamic data in combination with autonomous driving strategies.

If the engine controller (or powertrain controller) receives the current requested vehicle propulsion demand (torque or acceleration) and future vehicle propulsion demand, engine cylinder deactivation may be scheduled for ideal engine fuel efficiency. This allows the energy management strategy to maximize and extend the duration of engine cylinder deactivation operation, including vehicle cruising, passing, freeway entering/exiting maneuvers, etc. By having knowledge of the future vehicle acceleration/deceleration demand, the future engine load demand may be predicted and used to extend the duration of engine cylinder deactivation operation or alternatively modify the degree or level of engine cylinder deactivation (e.g. four-cylinder to six-cylinder operation on an eight-cylinder application) in order to meet the target vehicle trajectory set by the autonomous driving controller.

In an embodiment, the present invention is a connected energy management (CEM) system, which includes a strategy for controlling the activation of a plurality of engine cylinders in the engine of a vehicle. The CEM strategy is used with an engine having a plurality of cylinders, where a powertrain controller is operable for controlling the operation of the engine. A second controller is in electrical communication with the powertrain controller. In one embodiment, the second controller is a telematics controller, and in another embodiment, the second controller is an autonomous driving vehicle controller.

The second controller communicates at least one parameter to the powertrain controller, and the parameter is used to determine which of the plurality of cylinders are to be activated or deactivated. The powertrain controller then activates or deactivates one or more of the plurality of cylinders using the powertrain controller based on the parameter.

In the embodiment where a telematics controller is used, the parameter may be several parameters that include road data, such as both dynamic and static data. The static and dynamic data may include several different types of data, including, but not limited to, road curve shape, road grade, road surface, speed limits, traffic light data, vehicle traffic data, and vehicle accidents.

The vehicle includes an accelerator pedal and a brake pedal used for accelerating and decelerating the vehicle. The accelerator pedal is in electrical communication with the powertrain controller, and the desired load of the engine is controlled using the accelerator pedal, such that the load on the engine is changed based on the position of the accelerator pedal as detected by the powertrain controller. When incorporating the CEM strategy according to an embodiment of the present invention, one or more of the cylinders is activated or deactivated based on the at least one parameter, which may occur while propulsion torque is being requested (i.e., the driver is still applying force to the accelerator pedal). More specifically, when the driver of the vehicle has applied force to either the brake pedal or the accelerator pedal, the powertrain controller may activate or deactivate one or more of the cylinders to optimize efficiency of the engine.

In one embodiment, the CEM strategy may include a feedback mechanism which is used to communicate to the driver of the vehicle that the powertrain controller has activated or deactivated one or more of the plurality of cylinders, which may occur while the driver is still applying force to the accelerator pedal. In one embodiment, the feedback mechanism is a force-feedback accelerator pedal actuator, which works in opposition to the force applied to an accelerator pedal by the driver of the vehicle. In another embodiment, the feedback mechanism is an alert, which informs the driver of the vehicle that the powertrain controller has activated or deactivated one or more of the plurality of cylinders.

In the embodiment where the second controller is an autonomous driving vehicle controller, the parameter may be multiple parameters, including, but not limited to a current requested vehicle propulsion torque, and a future requested vehicle propulsion torque based on a target vehicle trajectory, such as a desired autonomous driving path. The powertrain controller activates or deactivates one or more of the plurality of cylinders based on the current requested vehicle propulsion torque and the future requested vehicle propulsion torque. More specifically, the autonomous driving vehicle controller communicates a plurality of data points to the powertrain controller. The plurality of data points represents the magnitude of the at least one parameter at a current time, and at least one future time. The powertrain controller activates or deactivates one or more of the cylinders using the data points at both the current time and the at least one future time to optimize efficiency such that the vehicle achieves the target vehicle trajectory (i.e., navigates the desired autonomous driving path).

The target vehicle trajectory may be used to predict the load demand on the engine based on the current requested vehicle propulsion torque and the future requested vehicle propulsion torque.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 2 is a table of several non-limiting examples of how an optimized engine cylinder deactivation strategy is implemented in a vehicle with advanced telematics, according to embodiments of the present invention;

DETAILED DESCRIPTION OF THE PREFERRED EMBODIMENTS

The following description of the preferred embodiment(s) is merely exemplary in nature and is in no way intended to limit the invention, its application, or uses.

Figure 1:
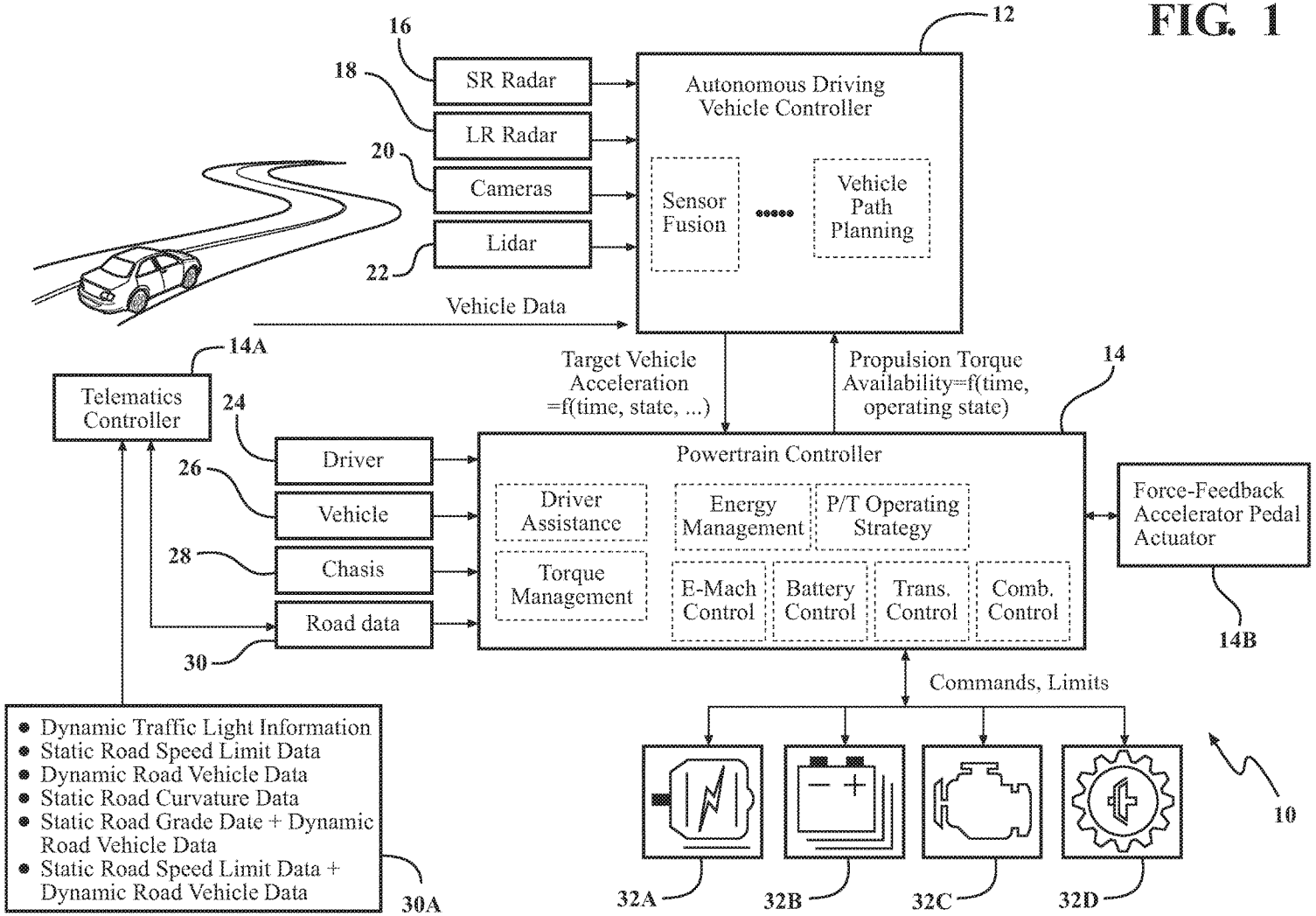
FIG. 1 is a diagram of an autonomous driving system which incorporates a cylinder deactivation strategy, according to embodiments of the present invention.

The present invention is an optimized engine cylinder deactivation strategy using connected energy management and autonomous driving strategies. Referring to FIG. 1, an autonomous driving system for a vehicle having a connected energy management (CEM) strategy is shown generally at 10. The system 10 includes an autonomous driving vehicle controller 12 in electrical communication with a powertrain controller 14. The autonomous driving vehicle controller 12 receives many different types of parameters based on input from various devices, such as short range (SR) Radar 16, long range (LR) Radar 18, cameras 20, and lidar 22, such that various autonomous driving maneuvers may be performed by the vehicle. The data received by the autonomous driving vehicle controller 12 from each of these devices is used to develop a plan for energy management, such as cylinder deactivation, where one or more cylinders are deactivated at various points in time as various autonomous driving maneuvers are performed such that the vehicle travels an autonomous driving path. In different embodiments, the powertrain controller 14 receives different parameters based on input from the vehicle driver 24, different types of vehicle input 26 (such as, but not limited to, vehicle speed, temperature, barometric pressure, and any other type of desired input from the vehicle), chassis 28, and various road data 30, and uses this information for energy management and to provide an operating strategy of the various powertrain components 32A-32D, such as at least one actuator, which in this embodiment is a traction drive motor 32A, a battery 32B, an engine 32C, and a driveline component 32D. The driveline component 32D may be any component in the driveline of the vehicle, such as a gear box or power split device.

The autonomous driving system 10 having the CEM strategy of the present invention expands the interface between the powertrain system of the vehicle and the autonomous driving controller 12, such that data received by both the autonomous driving vehicle controller 12 and the powertrain controller 14 may be used to provide for a more accurate CEM strategy for the vehicle, and potentially changes the operating state of one or more of the cylinders of the engine 32C at both a current operating time, in addition to multiple points in time in the future, to optimize the CEM strategy.

In one embodiment, the autonomous driving system 10 using a CEM strategy for cylinder deactivation applies to a vehicle with advanced telematics using the road data 30, including both static and dynamic data around the vehicle including, but not limited to: road map database data (curves, grades, surface, speed limits, etc), and dynamic road events (traffic light real-time data, vehicle traffic data per lane, vehicle accidents, etc.). The road data 30 may be obtained using some type of device, such as a telematics controller 14A, which is in communication with the powertrain controller 14, with examples of road data 30 obtained by the telematics controller 14A shown in at 30A in FIG. 1. A summary table with non-limiting examples of various driving situations from which road data 30 is generated is shown in FIG. 2. In this embodiment, the vehicle does not include the autonomous driving vehicle controller 12, and does not have autonomous driving capability. However, it is within the scope of the invention that the autonomous driving vehicle controller 12 may be included in this embodiment, such that the vehicle has autonomous driving capability, and the use of the telematics controller 14A and the autonomous driving vehicle controller 12 may be combined to further optimize the CEM strategy according to the present invention. In this embodiment, and all of the embodiments described in this application, the vehicle may also be an HEV (hybrid electric) vehicle, or the vehicle may be internal combustion only.

Figure 3:
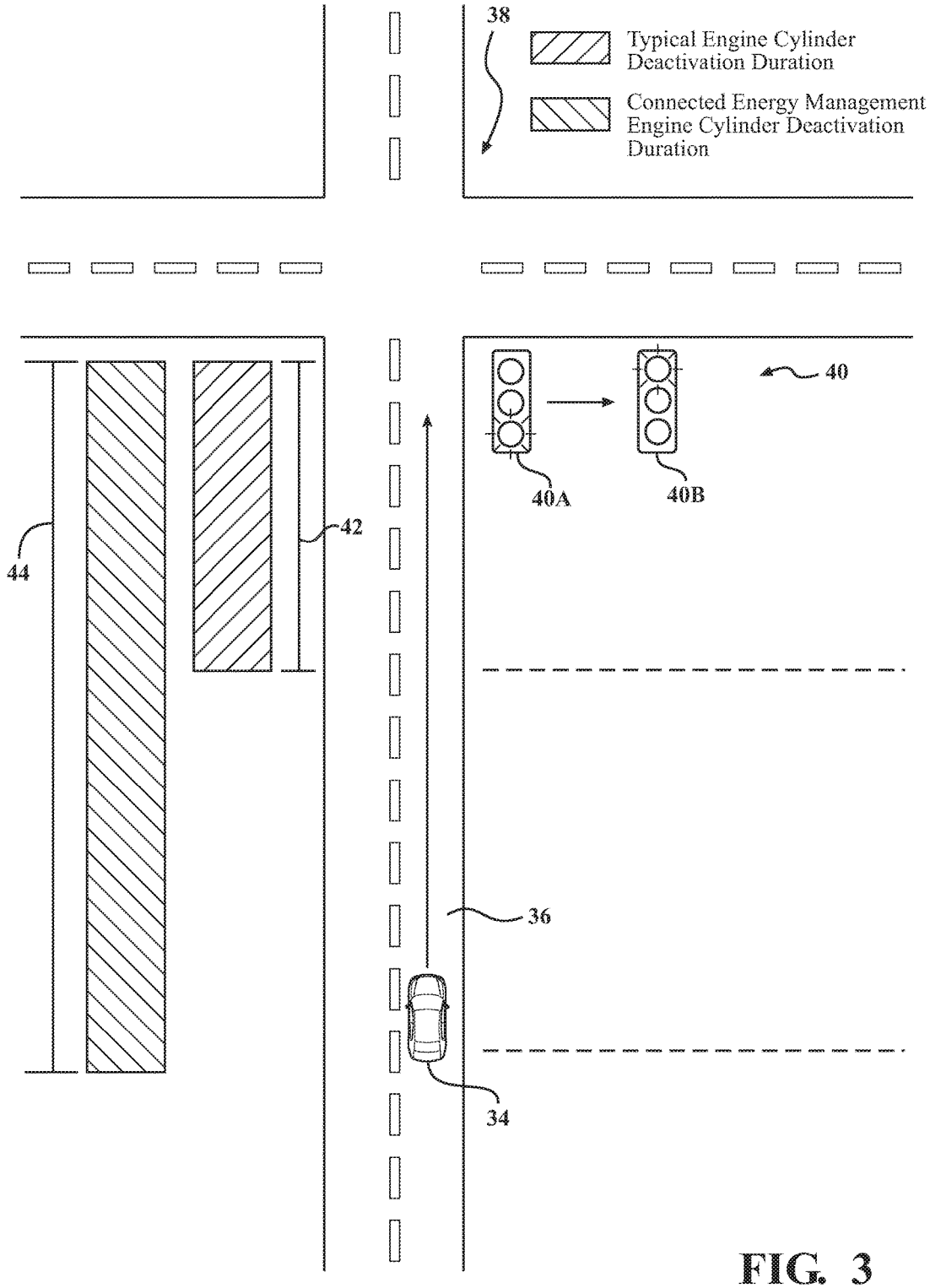
FIG. 3 is a diagram of an example of how an optimized engine cylinder deactivation strategy is used with dynamic traffic light data, according to embodiments of the present invention.

An example of an approach using a CEM strategy for engine cylinder deactivation using parameters which include road data 30, such as dynamic traffic light data information, according to the first embodiment of the present invention is shown in FIG. 3. In the example shown in FIG. 3, a vehicle 34 is shown which incorporates the CEM strategy according to the present invention, but only includes the powertrain controller 12 and the telematics controller 14A, and does not have the autonomous driving vehicle controller 12, and therefore does not have autonomous driving capability. The vehicle 34 is travelling on a road 36 towards an intersection, shown generally at 38, having a traffic light signal, shown generally at 40. The CEM strategy of the present invention in this example includes deactivating one or more of the engine cylinders of the vehicle 34, as the vehicle 34 approaches the traffic light signal 40.

Typically, with regard to a conventional engine cylinder deactivation, the deactivation is not scheduled until vehicle deceleration begins as the driver begins to release the accelerator pedal (i.e., "tips out"), and ultimately brakes, as the traffic light signal 40 is approached. The distance the vehicle has travelled while one or more of the engine cylinders has been deactivated (using a conventional cylinder deactivation strategy) is shown at 42.

The CEM strategy of the present invention involves triggering engine cylinder deactivation over a larger distance 44 by utilizing dynamic traffic light data 30A obtained by the telematics controller 14A. The traffic light signal 40 is shown with the green light illuminated shown at 40A, and the red light illuminated at 40B. The amount of time between the green light being illuminated and the red light being illuminated is communicated to the vehicle 34. In the example shown in FIG. 3, the cylinder deactivation occurs at an earlier point in time, as compared to conventional cylinder deactivation, leading to the cylinder deactivation occurring over the greater distance 44. This earlier cylinder deactivation in this example is triggered with the driver still requesting propulsion torque (i.e., the foot of the driver is still on the accelerator pedal). The vehicle 34 also includes some type of feedback mechanism, which is used to inform the driver of the vehicle 34 of the cylinder deactivation while propulsion torque is still being requested. In one embodiment, the feedback mechanism is provided through an alert, such as a telltale in the instrument cluster of the vehicle. Essentially, the driving situation shown in FIG. 3 is recognized by the powertrain controller 14, and a prediction of future engine load reduction triggers earlier engine cylinder deactivation. The example shown in FIG. 3 is only an illustrative non-limiting example, and similar strategies are applied in other driving situations (e.g. road curvatures, road grade changes, etc.) in the table shown in FIG. 2.

In an alternate embodiment, another type of feedback mechanism, such as a force-feedback accelerator pedal actuator 14B is included and controlled by the powertrain controller 14. The force-feedback accelerator pedal actuator 14B works in opposition to the force applied to the accelerator pedal by the driver of the vehicle 34. Earlier cylinder deactivation is initiated by the powertrain controller 14 through the use of the force-feedback accelerator pedal actuator 14B to communicate to the driver to stop application of the accelerator pedal. This is possible since vehicle deceleration up to the intersection 38 is predicted by the powertrain controller 14 by using the road data 30 and dynamic traffic light data 30A.

In another alternate embodiment, it is within the scope of the invention that in the example shown in FIG. 3, the autonomous driving vehicle controller 12 may be included in this embodiment, such that the vehicle 34 has autonomous driving capability, and the use of the telematics controller 14A and the autonomous driving vehicle controller 12 may be combined to further optimize the CEM strategy according to the present invention, when approaching the traffic signal 40.

Figure 4:
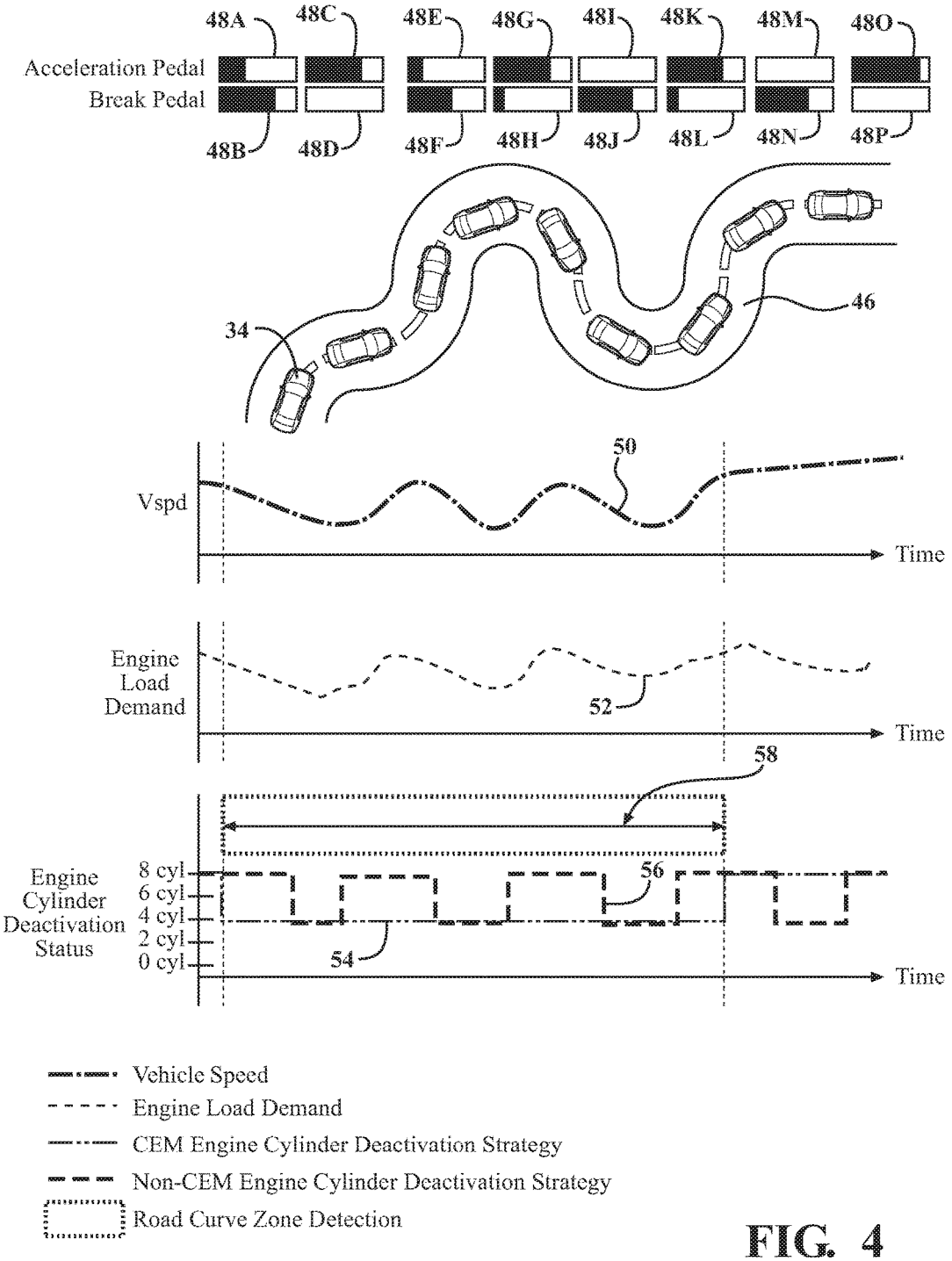
FIG. 4 is a diagram of an example of how an optimized engine cylinder deactivation strategy is used with road curve data, according to embodiments of the present invention.

The vehicle 34 incorporating another example of the CEM strategy according to the first embodiment of the present invention is shown in FIG. 4, where in this example, the vehicle 34 is being controlled by the driver to navigate a road 46 having several curves. In the example shown in FIG. 4, the vehicle 34 is shown using the CEM strategy according to the present invention, but only includes the powertrain controller 12 and the telematics controller 14A, and does not have the autonomous driving vehicle controller 12, and therefore does not have autonomous driving capability.

FIG. 4 also includes several pairs of graphic representations 48A-48P of the level of actuation of the brake pedal and accelerator pedal by the driver, with the accelerator pedal being represented by the graphics 48A,48C,48E,48G, 48I,48K,48M,48O and the brake pedal being represented by the graphics 48B,48D,48F,48H,48J,48L,48N,48P. FIG. 4 also includes a chart which includes several operating parameters, such as vehicle speed 50, engine load demand 52, as well as two different indications of cylinder activation/deactivation. There is an indication of cylinder activation/deactivation 54 which incorporates the CEM strategy of the present invention, and an indication of cylinder activation/deactivation 56 which is for conventional cylinder deactivation (for comparison purposes). Also generally shown is a zone 58 where the curvature of the road 46 is detected between time t1 and time t2.

Because the vehicle 34 includes the autonomous driving system 10 which uses the CEM strategy of the present invention, one of the parameters detected is the upcoming curves of the road 46, represented by the road curve zone 58 (which the vehicle 34 travels between time t1 and time t2), and various cylinders of the engine 32C are activated and deactivated as the vehicle 34 travels the road 46 without frequent hunting. The engine 32C has eight cylinders, and in the example shown in FIG. 4, the powertrain controller 14 changes the mode of operation of the engine 32C, where during a first mode of operation, four cylinders are active, and during a second mode of operation, eight cylinders are active, to optimize the operation of the engine 32C. The curvature of the road 46 is detected and anticipated, such that the road curve zone 58 is part of the road data 30, and starting at time t1 in FIG. 4, the engine 32C is operating in the first mode of operation, where only four cylinders are active, and the engine 32C remains in the first mode of operation until at least time t2, represented by 54 in FIG. 4.

In comparison, the cylinder activation/deactivation 56 of a vehicle which does not incorporate the CEM strategy of the present invention is shown in FIG. 4, where all eight cylinders are activated at various times between t1 and t2, as the brake pedal and accelerator pedal are depressed and released, as shown by 48A-48P, which increases fuel consumption, and reducing efficiency.

One of the advantages of implementing the CEM strategy of the present invention is that the average engine load demand is anticipated throughout the various curves of the road 46 (i.e., the road curve zone 58) such that cylinder deactivation is optimized without frequent hunting. This leads to overall fuel efficiency gains as the curves of the road 46 are navigated. Unnecessary cylinder deactivations/reactivations and corresponding torque surges are reduced or eliminated. This CEM strategy according to the present invention, which anticipates the road curvature or crossing detection, is not limited to a fixed-mode cylinder deactivation system, but also applies to any multi-mode cylinder deactivation system in which one or more cylinders may be fired or reactivated in any given engine cycle.

In another embodiment, it is within the scope of the invention that in the example shown in FIG. 4, the autonomous driving vehicle controller 12 may be included in this embodiment, such that the vehicle 34 has autonomous driving capability, and the use of the telematics controller 14A and the autonomous driving vehicle controller 12 may be combined to further optimize the CEM strategy according to the present invention, when navigating the curves of the road 46.

Figure 5:
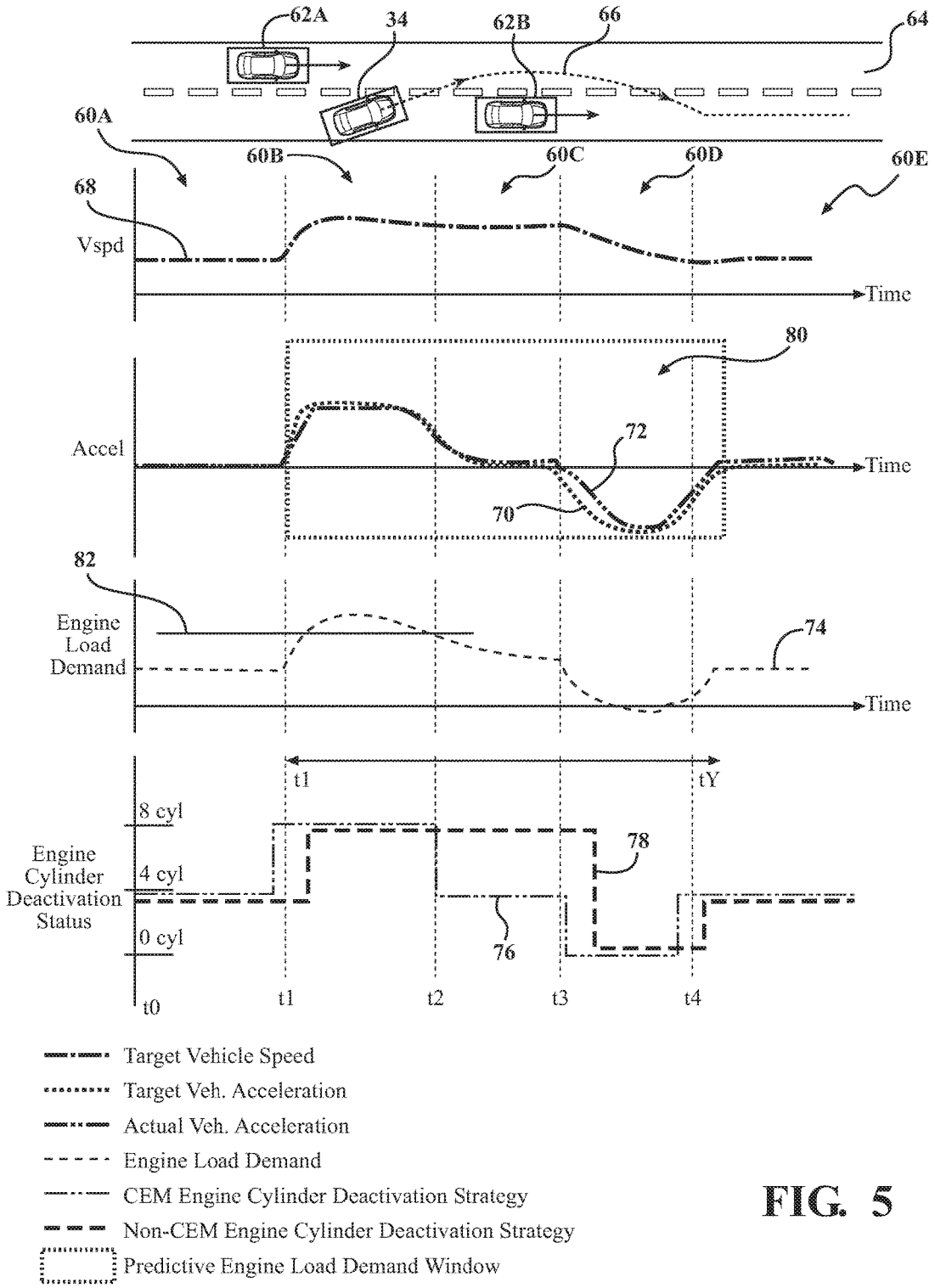
FIG. 5 is a diagram of an example of how an optimized engine cylinder deactivation strategy is used with autonomous driving data to perform a passing maneuver, according to embodiments of the present invention.

A second embodiment of the present invention is shown in FIG. 5, which includes a CEM strategy for cylinder deactivation which applies to a semi-automated or fully autonomous driving vehicle in which the current requested vehicle propulsion torque (or acceleration/deceleration), as well as future requested vehicle propulsion torque (or acceleration/deceleration), required for a target vehicle trajectory plan are known. In the example shown in FIG. 5, the vehicle 34 shown incorporates the CEM strategy according to the present invention, but includes the powertrain controller 12 and the autonomous driving vehicle controller 12, and does not include the telematics controller 14A. Engine cylinder deactivation scheduling may be predicatively scheduled (or engine cylinder deactivation inhibited) during various autonomous driving conditions. FIG. 5 illustrates an example where the vehicle 34 is in an autonomous driving mode, and is performing an autonomous driving maneuver, which in this example is a passing maneuver, while incorporating the CEM strategy for cylinder deactivation according to a second embodiment of the present invention.

The graphs in FIG. 5 are broken up into five phases, where the first phase 60A occurs between times t0 and t1, the second phase 60B occurs between times t1 and t2, the third phase 60C takes place between times t2 and t3, the fourth phase 60D takes place between times t3 and t4, and the fifth phase 60E takes place after time t4. Also shown in FIG. 5 is the vehicle 34 performing a passing maneuver while two other vehicles 62A,62B are also driving down the road 64. The autonomous driving vehicle controller 12 interprets the environment around the vehicle 34, and the position of each of the other vehicles 62A,62B relative to the vehicle 34, which is continuously changing as the vehicle 34 navigates the road 64. Based on the environment around the vehicle 34, and the position of the vehicles 62A,62B relative to the vehicle 34, the autonomous driving vehicle controller 12 uses these parameters to determine an autonomous driving path 66, which the vehicle 34 follows to perform the passing maneuver. The graphs in FIG. 5 depict other parameters, such as the target vehicle speed 68 and corresponding target vehicle acceleration 70, the actual measured vehicle acceleration 72, engine load demand 74, as well as a comparison of the activated cylinders, where one indication of active cylinders 76 occurs when the CEM strategy of the present invention is implemented for use with the vehicle 34. For comparison, another indication of active cylinders 78 is shown where a vehicle that does not use the CEM strategy of the present invention. Also shown in FIG. 5 is a threshold level 82, which represents the level at which the engine load demand 74 has increased to which all eight cylinders of the engine 32C are required to be active to meet the engine load demand 74.

As the vehicle 34 is moving on the road 64, the autonomous driving vehicle controller 12 determines the autonomous driving path 66 necessary for the passing maneuver to be performed. During the first phase 60A, the vehicle 34 is travelling at a substantially constant speed, and both the target vehicle acceleration 70 and actual measured vehicle acceleration 72 are substantially zero. The engine load demand 74 is also substantially constant, and the vehicle 34 is operating in the first mode of operation, where four cylinders are active. The autonomous driving vehicle controller 12 predicts and calculates the target acceleration 70 within a predictive engine load demand window 80, where the window 80 includes the target vehicle acceleration 70 needed to perform the entire passing maneuver, based on both the current requested vehicle propulsion torque, which occurs at the current time t1, and future requested propulsion torque, which occurs at a future time, such that the vehicle 34 achieves the target vehicle acceleration 70. The future time may occur at any point in time between t1 and tY in the predictive engine load demand window 80. The window 80 is broken up incrementally into a plurality of data points representing the various parameters, such that any number of data points may be used between times t1 and tY as the future time.

As mentioned above, the graphs in FIG. 5 are broken up into five phases 60A-60E. Although times t1, t2, t3, and t4 are shown, and are included as part of the plurality of data points, the data points used between t1 and tY may be such that an infinite number of data points are used. The predictive engine load demand window 80 may also be expanded to include a greater or lesser number of data points beyond both t1 and tY, where any number of the data points is used to represent the various parameters mentioned above.

The vehicle 34 begins to perform the passing maneuver beginning in the second phase 60B, where the engine load demand 74 increases, as the vehicle 34 accelerates and increases speed. It is shown in FIG. 5 that in the second phase 60B, the target vehicle speed 68 increases, and so does both the target vehicle acceleration 70 and measured vehicle acceleration 72. It is also shown in FIG. 5 that the engine load demand 74 passes the threshold level 82 (where all eight cylinders are needed to achieve the target vehicle acceleration 70) during the second phase 60B. The powertrain controller 14 is able to then switch the engine 32C to the second mode of operation, where all eight cylinders are active, prior to the second phase 60B, such that the engine 32C is generating the required torque necessary for the vehicle 34 to achieve the target vehicle acceleration 70. Because the autonomous driving vehicle controller 12 has determined the autonomous driving path 66, and the necessary corresponding torque, target vehicle acceleration 70, and target vehicle speed 68 needed throughout the entire predictive engine load demand window 80, the switch to the second mode of operation is performed prior to performing the passing maneuver, such that the target vehicle acceleration 70 is achieved in a more responsive and efficient manner.

Once the vehicle 34 has been accelerated to the target vehicle speed 68 to pass the second vehicle 62B, the vehicle 34 then remains at a substantially constant speed in the third phase 60C, such that the engine 32C is switched back to the first mode of operation, where only four cylinders are active.

After the vehicle 34 has passed the second vehicle 62B, the vehicle 34 is then decelerated during the fourth phase 60D. During the fourth phase 60D, since the vehicle 34 is being decelerated, the engine load demand 74 decreases during the fourth phase 60D, and is negative for a period of time. Because the engine load demand 74 is so low during the fourth phase 60D, the powertrain controller 14 changes the engine 32C to a third mode of operation, where none of the cylinders are active, the intake valves and exhaust valves are closed, and there is no fueling, reducing fuel consumption. During most of the fourth phase 60D, the engine 34 is operating in the third mode of operation, where no cylinders are active. In an alternate embodiment, during the fourth phase 60D, engine braking may be maximized by changing the engine 32C to the second mode of operation, where all eight cylinders are active, there is no fueling, and the intake valves and exhaust valves are open. This is typical deceleration fuel cut-off, and such that engine braking is used to gently decelerate the vehicle 34.

During the end of the fourth phase 60D, and knowing that a constant vehicle speed is then to be maintained after completion of the passing maneuver (in the fifth phase 60E), the CEM strategy of the present invention includes changing the engine 32C back to the first mode of operation, where only four cylinders are active because in the fifth phase 60E the target vehicle acceleration 70 in the future requested from the autonomous driving vehicle controller 12 is zero (i.e, zero acceleration). Once the vehicle 34 has completed the passing maneuver, and has completed deceleration, the vehicle 34 returns to travelling at a constant speed in the fifth phase 60E. The powertrain controller 14 maintains the operation of the engine 32C in the first mode of operation, where four cylinders are active.

In further regard to the CEM strategy according to the present invention, at time t0, the current and future engine load demand 74 (between times t1 and tY) is calculated based on the desired autonomous driving path 66 (and corresponding parameters including vehicle acceleration/deceleration or propulsion torque requests, as well as both the target vehicle speed 68 and target vehicle acceleration 70) provided by the autonomous driving vehicle controller 12. The CEM engine cylinder deactivation strategy of the present invention schedules the engine 32C to operate in the second mode of operation (all eight cylinders active) toward the end of the first phase 60A and during the second phase 60B in preparation to meet the required torque demand and target vehicle acceleration 70 needed for the vehicle 34 to perform the passing maneuver. At the beginning of the third phase 60C, vehicle longitudinal acceleration is no longer requested as the vehicle 34 is then passing at a constant speed, and ultimately the engine load demand 74 decreases, where the engine 32C is changed back to the first mode of operation, such that four cylinders are active. Unlike the non-CEM (conventional) cylinder deactivation approach, knowing the data points for each of the parameters, including the propulsion torque demand for the entire predictive engine load demand window 80, allows for a more optimized cylinder deactivation operating strategy.

As shown in FIG. 5, when comparing the two indications of active cylinders 76,78, it is seen that when using the CEM strategy of the present invention, the powertrain controller 14 changes the engine 32C from the first mode of operation, where four cylinders are active, to the second mode of operation, were eight cylinders are active, prior to the second phase 60B. The engine 32C then remains in the second mode of operation through the second phase 60B, and is then changed back to the first mode of operation in the third phase 60C.

This is in contrast to when the CEM strategy of the present invention is not used, where as shown by the indication of active cylinders 78, the powertrain controller 14 does not change the engine 32C from the first mode of operation to the second mode of operation until after t1 in the second phase 60B, and switches to the third mode of operation after time t3 in the fourth phase 60D. The engine 32C does not revert back to the first mode of operation until during the fifth phase 60E (after time t4).

In FIG. 5, an engine cylinder deactivation strategy which does not use the CEM strategy of the present invention operates primarily based on the current engine load demand at the current operating conditions (engine, vehicle, etc.), and does not take into account any future engine load demand or operating conditions. In the example shown in FIG. 5, the engine 32C is initially operating in the first mode of operation, where four cylinders are active, at the initial engine load demand 74 before the requested engine load demand 74 increases at time t1 (due to the vehicle 34 performing the passing maneuver as commanded by the autonomous driving vehicle controller 12), which is the earliest point that the typical cylinder deactivation strategy changes the engine 32C to the second mode of operation, where all eight cylinders are active as shown by the indication of active cylinders 78. Shortly after time t1, all eight cylinders are active, while the vehicle 34 accelerates to perform the passing maneuver during the second phase 60B and the third phase 60C. Once the autonomous driving vehicle controller 12 reduces the vehicle acceleration request starting in the fourth phase 60D, the powertrain controller 14 ultimately schedules all eight cylinders to be deactivated (between times t3 and t4) as shown by the indication of active cylinders 78, when the vehicle 34 is decelerating during the fourth phase 60D, and engine load demand 70 is minimal, or slightly negative. Starting in the fifth phase 60E when the autonomous driving vehicle controller 12 requests the target vehicle acceleration 70 to be zero to maintain the current speed of the vehicle 34, the cylinder deactivation strategy (which does not use the CEM strategy of the present invention) schedules the first mode of operation (i.e., four cylinders active) based on the required engine load demand 74 for the current speed of the vehicle 34.

Furthermore, when comparing the indication of active cylinders 78 (which does not use the CEM strategy of the present invention) to the indication of active cylinders 76 (which incorporates the CEM strategy of the present invention), it is shown by that there is a lag when changing from the first mode of operation to the second mode of operation near time t1. The indication of active cylinders 78 also shows the change from the second mode of operation directly to the third mode of operation after time t3 in the fourth phase 60D, which is different from the indication of active cylinders 76, which transitions to back to the first mode of operation during the third phase 60C, instead of remaining in the second mode of operation during the third phase 60C. The indication of active cylinders 78 indicates the engine 32C remains in the second mode of operation for a longer period of time, increasing fuel consumption, and reducing efficiency. There is another lag when changing from the third mode of operation back to the first mode of operation around time t4. Furthermore, when the CEM strategy of the present invention is not used, the vehicle 34 may not perform the passing maneuver as desired, or reach the target vehicle acceleration 70, because of the lag which occurs when changing between the first mode of operation (four cylinder active) and the second mode of operation (eight cylinders active). Using the CEM strategy of the present invention provides a more optimized use of available engine torque.

While the example shown in FIG. 5 illustrates a CEM strategy of the present invention for a cylinder deactivation system having three modes of operation (i.e., four cylinders active, eight cylinders active, and zero cylinders active), the concept of the present invention applies to any fixed X-mode or multi-mode cylinder deactivation system in which one or more cylinders may be deactivated during a given engine cycle.

In another embodiment, it is within the scope of the invention that in the example shown in FIG. 5, the telematics controller 14A may be included in this embodiment, such that the vehicle 34 has connective capability, and the use of the telematics controller 14A and the autonomous driving vehicle controller 12 may be combined to further optimize the CEM strategy according to the present invention, when performing an autonomous driving maneuver, such as the passing maneuver shown in FIG. 5.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A connected energy management cylinder deactivation system, comprising:

an engine having a plurality of cylinders;

a powertrain controller operable for controlling operation of the engine;

an autonomous driving vehicle controller in electrical communication with the powertrain controller;

at least one parameter received by the autonomous driving vehicle controller, the at least one parameter used to determine which of the plurality of cylinders are to be activated and deactivated, the at least one parameter being communicated to the powertrain controller from the autonomous driving controller;

a plurality of data points representing the at least one parameter;

a current time, at least one of the plurality of data points representing a magnitude of the at least one parameter at the current time; and at least one future time, another of the plurality of data points representing a magnitude of the at least one parameter at the at least one future time;

wherein the powertrain controller activates or deactivates one or more of the plurality of cylinders based on the plurality of data points at both the current time and the at least one future time.

2. The connected energy management cylinder deactivation system of claim 1, the at least one parameter further comprising:

a current requested vehicle propulsion torque;

a future requested vehicle propulsion torque based on a target vehicle trajectory;

wherein the powertrain controller activates or deactivates one or more of the plurality of cylinders based on the current requested vehicle propulsion torque and the future requested vehicle propulsion torque.

3. The connected energy management cylinder deactivation system of claim 2, wherein load demand on the engine is predicted based on the current requested vehicle propulsion torque and the future requested vehicle propulsion torque to achieve the target vehicle trajectory.

4. An connected energy management cylinder deactivation system, comprising:

an engine having a plurality of cylinders;

a powertrain controller operable for controlling operation of the engine;

an autonomous driving vehicle controller in electrical communication with the powertrain controller;

a telematics controller in electrical communication with the powertrain controller;

a plurality of parameters received by the autonomous driving vehicle controller, the plurality of parameters used to determine which of the plurality of cylinders are to be activated and deactivated, a portion of the plurality of parameters being communicated to the powertrain controller from the autonomous driving vehicle controller, and a portion of the parameters being communicated to the powertrain controller from the telematics controller;

a plurality of data points representing the at least one parameter;

a current time, at least one of the plurality of data points representing a magnitude of the at least one parameter at the current time; and at least one future time, another of the plurality of data points representing a magnitude of the at least one parameter at the at least one future time;

wherein the powertrain controller activates or deactivates one or more of the plurality of cylinders based on the plurality of data points at both the current time and the at least one future time.

5. The connected energy management cylinder deactivation system of claim 4, wherein the powertrain controller activates or deactivates one or more of the plurality of cylinders while propulsion torque is being requested.

6. The connected energy management cylinder deactivation system of claim 4, the plurality of parameters further comprising:

dynamic data;

static data;

a current requested vehicle propulsion torque; and a future requested vehicle propulsion torque based on a target vehicle trajectory;

wherein the powertrain controller activates or deactivates one or more of the plurality of cylinders based on the static data, dynamic data, the current requested vehicle propulsion torque and the future requested vehicle propulsion torque.

7. The connected energy management cylinder deactivation system of claim 6, wherein load demand on the engine is predicted based on the current requested vehicle propulsion torque and the future requested vehicle propulsion torque to achieve the target vehicle trajectory.

8. The connected energy management cylinder deactivation system of claim 4, further comprising a feedback mechanism, wherein the feedback mechanism communicates to a driver of the vehicle that the powertrain controller has activated or deactivated one or more of the plurality of cylinders.

9. A method for controlling activation of a plurality of engine cylinders, comprising the steps of:

providing an engine having a plurality of cylinders;

providing a powertrain controller operable for controlling operation of the engine;

providing an autonomous driving vehicle controller in electrical communication with the powertrain controller;

providing a plurality of parameters received by the autonomous driving vehicle controller;

providing a plurality of data points representing the plurality of parameters;

providing a current time; and providing at least one future time;

communicating the plurality of parameters from the second controller to the powertrain controller;

using the plurality of parameters to determine which of the plurality of cylinders are to be activated or deactivated;

representing a magnitude of each of the plurality of parameters at the current time using the at least one of the plurality of data points;

representing a magnitude of the plurality of parameters at the at least one future time using another of the plurality of data points;

activating or deactivating one or more of the plurality of cylinders using the powertrain controller based on the plurality of data points at both the current time and the at least one future time.

10. The method of claim 9, further comprising the steps of activating or deactivating one or more of the plurality of cylinders while propulsion torque is being requested.

11. The method of claim 9, further comprising the steps of:

providing a feedback mechanism;

using the feedback mechanism to communicate to a driver of the vehicle that the powertrain controller has activated or deactivated one or more of the plurality of cylinders.

12. The method of claim 11, further comprising the steps of:

providing the feedback mechanism to be a force-feedback accelerator pedal actuator;

opposing a force applied to an accelerator pedal by the driver of the vehicle with the force-feedback accelerator pedal actuator when the powertrain controller has activated or deactivated one or more of the plurality of cylinders based on the plurality of parameters.

13. The method of claim 11, further comprising the steps of:

providing the feedback mechanism to be an alert;

using the alert to inform the driver of the vehicle that the powertrain controller has activated or deactivated one or more of the plurality of cylinders.

14. The method of claim 9, further comprising the steps of providing the plurality of parameters to further comprise:

a current requested vehicle propulsion torque;

a future requested vehicle propulsion torque based on a target vehicle trajectory;

activating or deactivating one or more of the plurality of cylinders based on the current requested vehicle propulsion torque and the future requested vehicle propulsion torque.

15. The method of claim 14, further comprising the steps of predicting load demand on the engine based on the current requested vehicle propulsion torque and the future requested vehicle propulsion torque to achieve the target vehicle trajectory.

* * * * *